US010126679B2

(12) United States Patent
Oikawa et al.

(10) Patent No.: US 10,126,679 B2
(45) Date of Patent: Nov. 13, 2018

(54) DEVELOPING CASING OF A DEVELOPING UNIT FOR AN ELECTROPHOTOGRAPHIC IMAGE FORMING APPARATUS HAVING A DEVELOPER COLLECTION INLET TO COLLECT DEVELOPER MOVING ALONG A DISCHARGE PATH

(71) Applicant: S-Printing Solution Co., Ltd., Suwon-si (KR)

(72) Inventors: Mitsuru Oikawa, Seongnam-si (KR); Dong-uk Kim, Hwaseong-si (KR); Jong-hyun Park, Hwaseong-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/690,567

(22) Filed: Aug. 30, 2017

(65) Prior Publication Data

US 2018/0157192 A1 Jun. 7, 2018

(30) Foreign Application Priority Data

Dec. 6, 2016 (KR) ..... 10-2016-0165171

(51) Int. Cl.
*G03G 15/08* (2006.01)
*G03G 15/095* (2006.01)

(52) U.S. Cl.
CPC ..... *G03G 15/0822* (2013.01); *G03G 15/0808* (2013.01); *G03G 15/0844* (2013.01); *G03G 15/0891* (2013.01); *G03G 15/095* (2013.01)

(58) Field of Classification Search
CPC ..... G03G 15/0822; G03G 15/095; G03G 15/0808; G03G 15/0844; G03G 15/0891
See application file for complete search history.

(56) References Cited

U.S. PATENT DOCUMENTS

| | | | | |
|---|---|---|---|---|
| 2006/0078348 | A1 | 4/2006 | Watanabe et al. | |
| 2006/0083541 | A1 | 4/2006 | Nagata et al. | |
| 2008/0018707 | A1 | 1/2008 | Masuyama et al. | |
| 2008/0199223 | A1* | 8/2008 | Tateyama | G03G 15/0822 399/254 |
| 2011/0229207 | A1* | 9/2011 | Matsumoto | G03G 15/0822 399/254 |
| 2011/0311263 | A1 | 12/2011 | Mizuta | |
| 2016/0041504 | A1* | 2/2016 | Ueda | G03G 15/095 399/359 |

FOREIGN PATENT DOCUMENTS

| | | |
|---|---|---|
| EP | 2138311 B1 | 3/2015 |
| JP | 2014-115324 | 6/2014 |

* cited by examiner

*Primary Examiner* — David M. Gray
*Assistant Examiner* — Laura Roth
(74) *Attorney, Agent, or Firm* — Staas & Halsey LLP

(57) ABSTRACT

A developing unit includes a developing roller, a developing casing to support and allow the developing roller to rotate, the developing casing including a developer supply inlet, a developer discharge outlet, and a developer collection inlet. The developing unit further includes a discharge cover to form a discharge path for a developer discharged from the developer discharge outlet along with the developing casing. The developer collection inlet is positioned in the discharge path to collect a part of the developer moving along the discharge path into the developing casing.

19 Claims, 13 Drawing Sheets

DEVELOPING CASING OF A DEVELOPING UNIT FOR AN ELECTROPHOTOGRAPHIC IMAGE FORMING APPARATUS HAVING A DEVELOPER COLLECTION INLET TO COLLECT DEVELOPER MOVING ALONG A DISCHARGE PATH

CROSS-REFERENCE TO RELATED APPLICATIONS

This application claims the benefit of Korean Patent Application No. 10-2016-0165171, filed on Dec. 6, 2016, in the Korean Intellectual Property Office, the disclosure of which is incorporated herein in its entirety by reference.

BACKGROUND

1. Field

The present disclosure relates to developing units and electrophotographic image forming apparatuses employing the same.

2. Description of the Related Art

An electrophotography-based image forming apparatus forms a visible toner image on a photoconductor by supplying a toner to an electrostatic latent image formed on the photoconductor, transferring the toner image onto a recording medium, and then fixing the transferred toner image on the recording medium. As such, an image is printed on the recording medium. A developing unit contains a developer (toner) and forms the visible toner image on the photoconductor by supplying the toner to the electrostatic latent image formed on the photoconductor.

As a developing method, a one-component developing method using only toner as a developer and a two-component developing method using a toner and a carrier as a developer have been used. When the two-component developing method is used, the performance of a carrier in a developing unit deteriorates due to repeated use thereof. Accordingly, a trickle developing method of supplying a new developer into the developing unit and discharging a surplus developer from the developing unit has been employed.

In the case of a developing unit using the trickle developing method, as a process speed increases, air pressure inside the developing unit increases and the amount of toner scattered to the outside of the developing unit may increase too. In addition, an amount of air discharged through a developer outlet through which the developer is discharged increases, and an amount (an airflow discharge amount) of the developer discharged by being carried in the air increases, which makes it difficult to maintain an amount of the developer in the developing unit at an appropriate level. If a sealing level of the developing unit is increased in order to prevent toner scattering, air may concentrate in the developer outlet, and thus, the airflow discharge amount may increase. Also, if the airflow discharge amount is reduced, the air pressure inside the developing unit increases and thus toner scattering may increase.

SUMMARY

Provided are developing units capable of stably maintaining an amount of a developer therein and electrophotographic image forming apparatuses employing the same.

Provided are developing units capable of preventing toner scattering by inhibiting air pressure therein and electrophotographic image forming apparatuses employing the same.

Additional aspects will be set forth in part in the description which follows and, in part, will be apparent from the description, or may be learned by practice of the presented embodiments.

According to an aspect of an embodiment, a developing unit includes: a developing roller; a developing casing configured to support and allow the developing roller to rotate and including a developer supply inlet, a developer discharge outlet, and a developer collection inlet; and a discharge cover configured to form a discharge path for a developer discharged from the developer discharge outlet along with the developing casing, wherein the developer collection inlet is positioned in the discharge path to collect a part of the developer moving along the discharge path into the developing casing.

A vertical projection area of the developer discharge outlet may partially overlap a vertical projection area of the developer collection inlet.

The developer collection inlet may be disposed on a downstream side of the developer discharge outlet with respect to a flow direction of the developer toward the developer discharge outlet in the developing casing.

The developer supply inlet may be disposed on a downstream side of the developer discharge outlet with respect to a flow direction of the developer.

The developer discharge outlet, the developer supply inlet, and the developer collection inlet may be located outside an effective length of the developing roller.

The developing unit may further include: a collection guide member provided in the discharge path and configured to guide a part of the developer discharged along the discharge path to the developer collection inlet.

An end of the collection guide member on a side of the developer discharge outlet may be positioned closer to the developer discharge outlet than an end of the developer collection inlet on the side of the developer discharge outlet.

The developing casing may include: a supplier in which the developing roller and a first stirring member configured to convey a developer are installed; a stirrer in which a second stirring member configured to convey the developer in a second direction an opposite direction to a first direction is installed; and a partition configured to separate the supplier and the stirrer from each other and having first and second openings at both ends that allow the supplier and the stirrer to communicate each other.

An end of the collection guide member on a side of the developer discharge outlet may be closer to the developer discharge outlet than the partition.

The supplier may be positioned above the stirrer in a gravitational direction, wherein the developer discharge outlet is provided in the supplier, and wherein the developer collection inlet is provided in the stirrer.

The developing roller may be positioned above the supplier in the gravitational direction.

The developing roller may be positioned on a lateral side of the supplier and the stirrer, wherein a first horizontal line passing through a center of the developing roller is between a second horizontal line passing through a center of the first stirring member and a third horizontal line passing through a center of the second stirring member, and wherein the stirrer is configured to face the developing roller and collect a developer from the developing roller.

The supplier may be positioned below the stirrer in a gravitational direction, wherein the developing roller is positioned on a lateral side of the supplier and the stirrer wherein a second vertical line passing through a center of the first stirring member is between a third vertical line passing through a center of the second stirring member and a first vertical line passing through a center of the developing roller, and wherein the stirrer is configured to face the developing roller and collect a developer from the developing roller.

The developer discharge outlet may be provided in the stirrer, and wherein the developer collection inlet is provided in the supplier.

The supplier and the stirrer may be disposed in a lateral direction.

The developing discharge outlet may include a first developer discharge outlet provided in the supplier, wherein the developer collection inlet is provided in the stirrer, and wherein the discharge cover is configured to form the discharge path above the first developer discharge outlet and the developer collection inlet.

The collection guide member may extend from the inside of the discharge cover toward the developer collection inlet so that a developer discharged from the first developer discharge outlet is partially guided to the developer collection inlet.

The developer discharge outlet may further include a second developer discharge outlet provided in the stirrer, wherein the second developer discharge outlet is positioned in a downstream side of the developer collection inlet with respect to the discharge path.

According to an aspect of another embodiment, an electrophotographic image forming apparatus includes: the developing unit, which is configured to supply and develop a toner onto an electrostatic latent image formed on a photoconductor; a transferor configured to transfer a toner image onto a recording medium; and a fuser configured to fuse the toner image on the recording medium.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
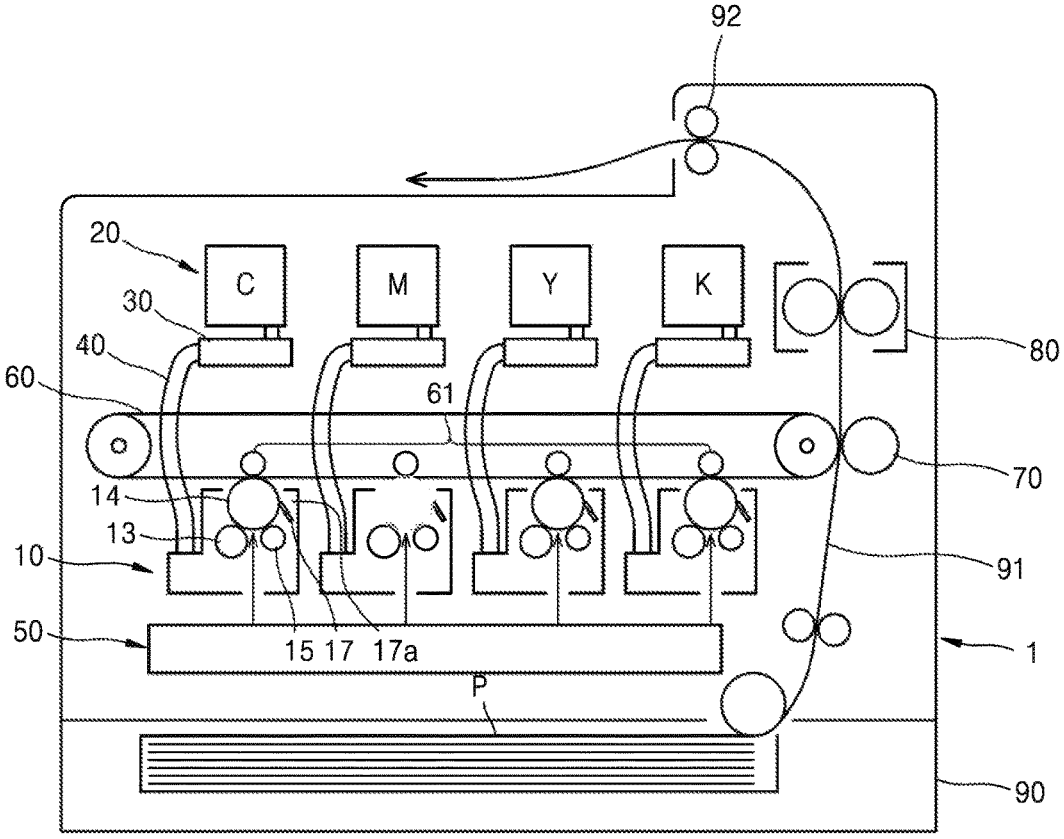
FIG. 1 is a structural view of an electrophotographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items.

FIG. 1 is a structural view of an electrophotographic image forming apparatus according to an embodiment. The image forming apparatus according to the current embodiment prints color images using electrophotography. Referring to FIG. 1, the image forming apparatus may include a plurality of developing units 10, an exposer 50, a transferor, and a fuser 80. The image forming apparatus may further include a plurality of developer cartridges 20 for containing developers. The developer cartridges 20 are separately connected to the developing units 10, and the developers in the developer cartridges 20 are separately supplied to the developing units 10. The developer cartridges 20 and the developing units 10 may be individually replaced.

The developing units 10 may include a plurality of developing units 10C, 10M, 10Y, and 10K for developing cyan (C), magenta (M), yellow (Y), and black (K) developers, respectively. The developer cartridges 20 may include a plurality of developer containers 20C, 20M, 20Y, and 20K separately containing the C, M, Y, and K developers to be supplied to the developing units 10C, 10M, 10Y, and 10K. However, the scope of the present disclosure is not limited thereto, and the image forming apparatus may further include a plurality of developer cartridges 20 and a plurality of developing units 10 for containing and developing developers of various colors other than the above-mentioned colors, e.g., light magenta and white. In the following description, it is assumed that the image forming apparatus includes the developing units 10C, 10M, 10Y, and 10K and the developer cartridges 20C, 20M, 20Y, and 20K, and C, M, Y, and K following reference numerals denote elements for developing cyan, magenta, yellow, and black developers, respectively, unless the context clearly indicates otherwise.

Each developing unit 10 may include a photosensitive drum 14 for forming an electrostatic latent image on the surface thereof, and a developing roller 13 for developing the electrostatic latent image into a visible toner image by supplying the developer to the electrostatic latent image. The photosensitive drum 14 is an example of a photoconductor for forming an electrostatic latent image on the surface thereof, and may include a conductive metal pipe, and a photosensitive layer provided on an outer circumferential surface of the conductive metal pipe. A charging roller 15 is an example of a charger for charging the photosensitive drum 14 to have a uniform surface potential. A charging brush, a corona charger, or the like may be employed instead of the charging roller 15.

The developing unit 10 may further include a charging roller cleaner (not shown) for removing a foreign substance adhered to the charging roller 15, e.g., the developer or dust, a cleaning member 17 for removing the developer remaining on the surface of the photosensitive drum 14 after an intermediate transfer operation to be described below, and a regulation member (not shown) for regulating the amount of the developer supplied to a developing area where the photosensitive drum 14 and the developing roller 13 face each other.

A toner and a carrier from the developer cartridge 20 are supplied to the developing unit 10. The developing roller 13 is spaced apart from the photosensitive drum 14. A gap between an outer circumferential surface of the developing roller 13 and an outer circumferential surface of the photosensitive drum 14 may be, for example, several ten to several hundred microns. The developing roller 13 may be a magnetic roller. Also, the developing roller 13 may include a magnet (13*b* of FIG. 2) disposed in a developing sleeve (13*a* of FIG. 2) that is rotatable. The toner is mixed with the carrier in the developing unit 10, and is adhered to the surface of the magnetic carrier. The magnetic carrier is adhered to the surface of the developing roller 13 and is carried to the developing area where the photosensitive drum 14 and the developing roller 13 face each other. Due to a developing bias voltage applied between the developing roller 13 and the photosensitive drum 14, only the toner is supplied to the photosensitive drum 14 and thus the electrostatic latent image formed on the surface of the photosensitive drum 14 is developed into a visible image. To constantly maintain an amount of the developer in the developing unit 10, a surplus amount of the carrier is discharged to the outside the developing unit 10 with the toner.

The exposer 50 is an element for forming electrostatic latent images on the photosensitive drums 14 by irradiating light modulated to correspond to image information, onto the photosensitive drums 14. A representative example thereof is a laser scanning unit (LSU) using a laser diode as a light source, or a light-emitting diode (LED) exposer using an LED as a light source.

The transferor transfers the toner image formed on the photosensitive drums 14 onto a recording medium P. In the present embodiment, an intermediate transfer type transferor is employed. For example, the transferor may include an intermediate transfer belt 60, an intermediate transfer roller 61, and a transfer roller 70.

The intermediate transfer belt 60 temporarily contains toner images developed on the photosensitive drums 14 of the developing units 10C, 10M, 10Y, and 10K. A plurality of intermediate transfer rollers 61 are provided to face the photosensitive drums 14 of the developing units 100, 10M, 10Y, and 10K interposing the intermediate transfer belt 60 therebetween. An intermediate transfer bias voltage for intermediately transferring the toner images developed on the photosensitive drums 14 onto the intermediate transfer belt 60 is applied to the intermediate transfer rollers 61. Corona transferers or pin-scorotron transferers may be employed instead of the intermediate transfer rollers 61.

The transfer roller 70 is located to face the intermediate transfer belt 60. A transfer bias voltage for transferring the toner images transferred onto the intermediate transfer belt 60 onto a recording medium P is applied to the transfer roller 70.

The fuser 80 applies heat and/or pressure to the toner images transferred onto the recording medium P, and thus fixes the toner images on the recording medium P. The fuser 80 is not limited to the configuration illustrated in FIG. 1.

Due to the above-described configuration, the exposer 50 forms electrostatic latent images on the photosensitive drums 14 of the developing units 100, 10M, 10Y, and 10K by irradiating light modulated to correspond to image information of a plurality of colors, onto the photosensitive drums 14 of which a surface is charged in a uniform potential by the charging roller 15. The electrostatic latent images of the photosensitive drums 14 of the developing units 10C, 10M, 10Y, and 10K are developed into visible toner images due to the C, M, Y, and K developers supplied from the developer cartridges 20C, 20M, 20Y, and 20K to the developing units 10C, 10M, 10Y, and 10K. The developed toner images are sequentially and intermediately transferred onto the intermediate transfer belt 60. The recording medium P accommodated in a feeding member 90 is fed along a feeding path 91 and is supplied between the transfer roller 70 and the intermediate transfer belt 60. The toner images intermediately transferred onto the intermediate transfer belt 60 are transferred onto the recording medium P due to a transfer bias voltage applied to the transfer roller 70. After the recording medium P passes through the fuser 80, the toner images are fixed on the recording medium P due to heat and pressure. The recording medium P, on which the toner images are completely fixed, is discharged by discharge rollers 92.

The developer contained in the developer cartridge 20 is supplied to the developing unit 10. When the developer contained in the developer cartridge 20 is completely consumed, the developer cartridge 20 may be replaced with a new developer cartridge 20 or a new developer may be filled in the developer cartridge 20.

The image forming apparatus may further include developer supply units 30. Each developer supply unit 30 receives the developer from the developer cartridge 20 and supplies the same to the developing unit 10. The developer supply unit 30 may be connected through a supply tube 40 to the developing unit 10.

Although not shown in FIG. 1, the developer supply unit 30 may be omitted and the supply tube 40 may directly interconnect the developer cartridge 20 to the developing unit 10.

Figure 2:
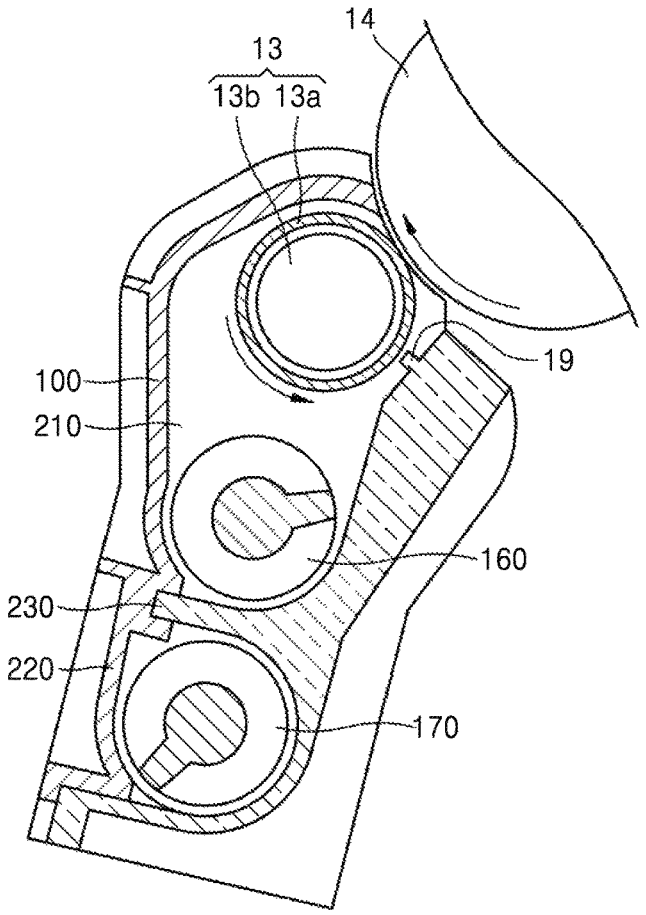
FIG. 2 is a cross-sectional view of a developing unit according to an embodiment.
Figure 3:
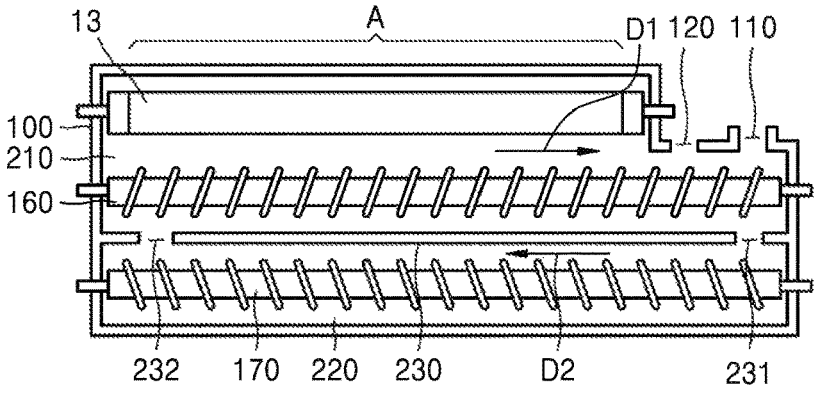
FIG. 3 is a schematic side view of a developing unit according to an embodiment.
Figure 4:
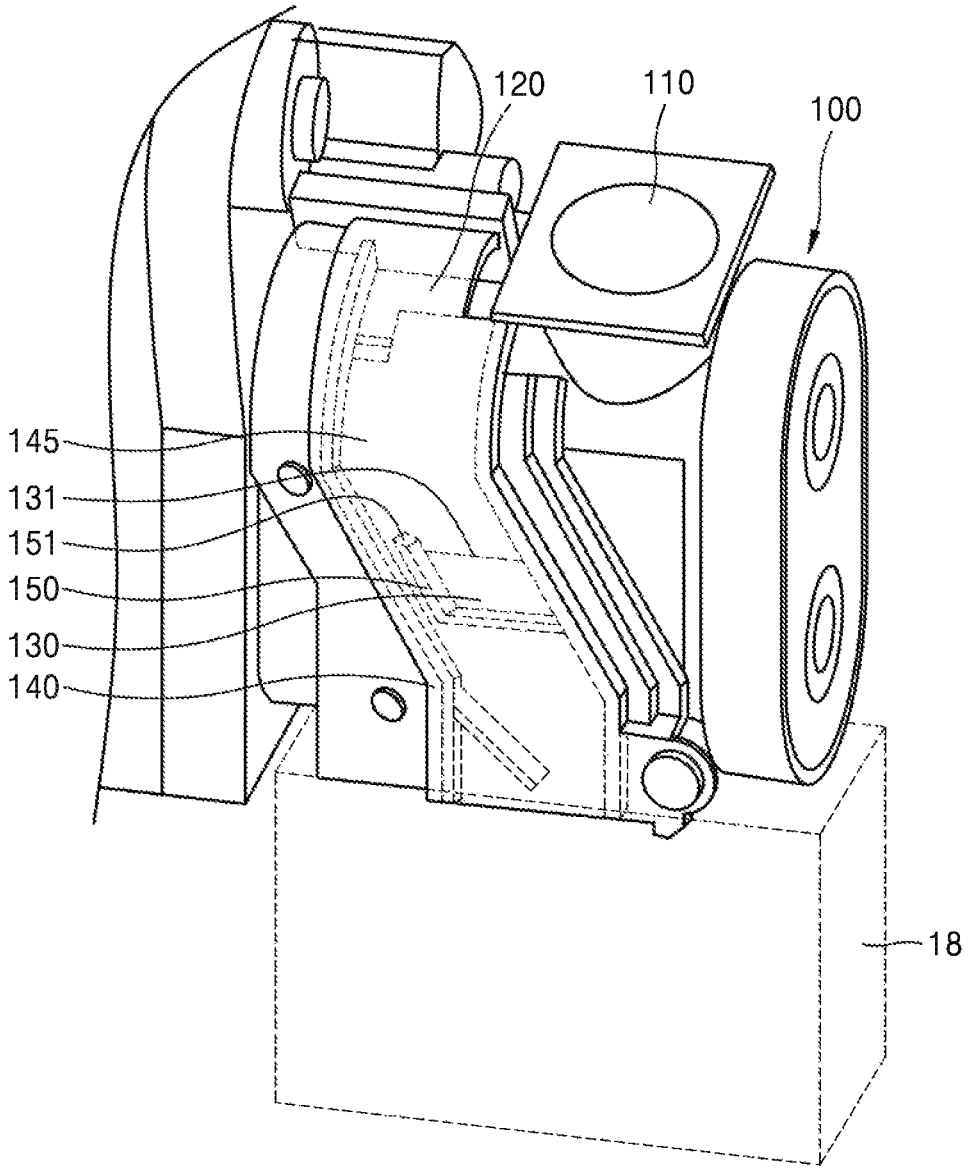
FIG. 4 is a partial perspective view of a developing unit showing a developer discharging structure.
Figure 5:
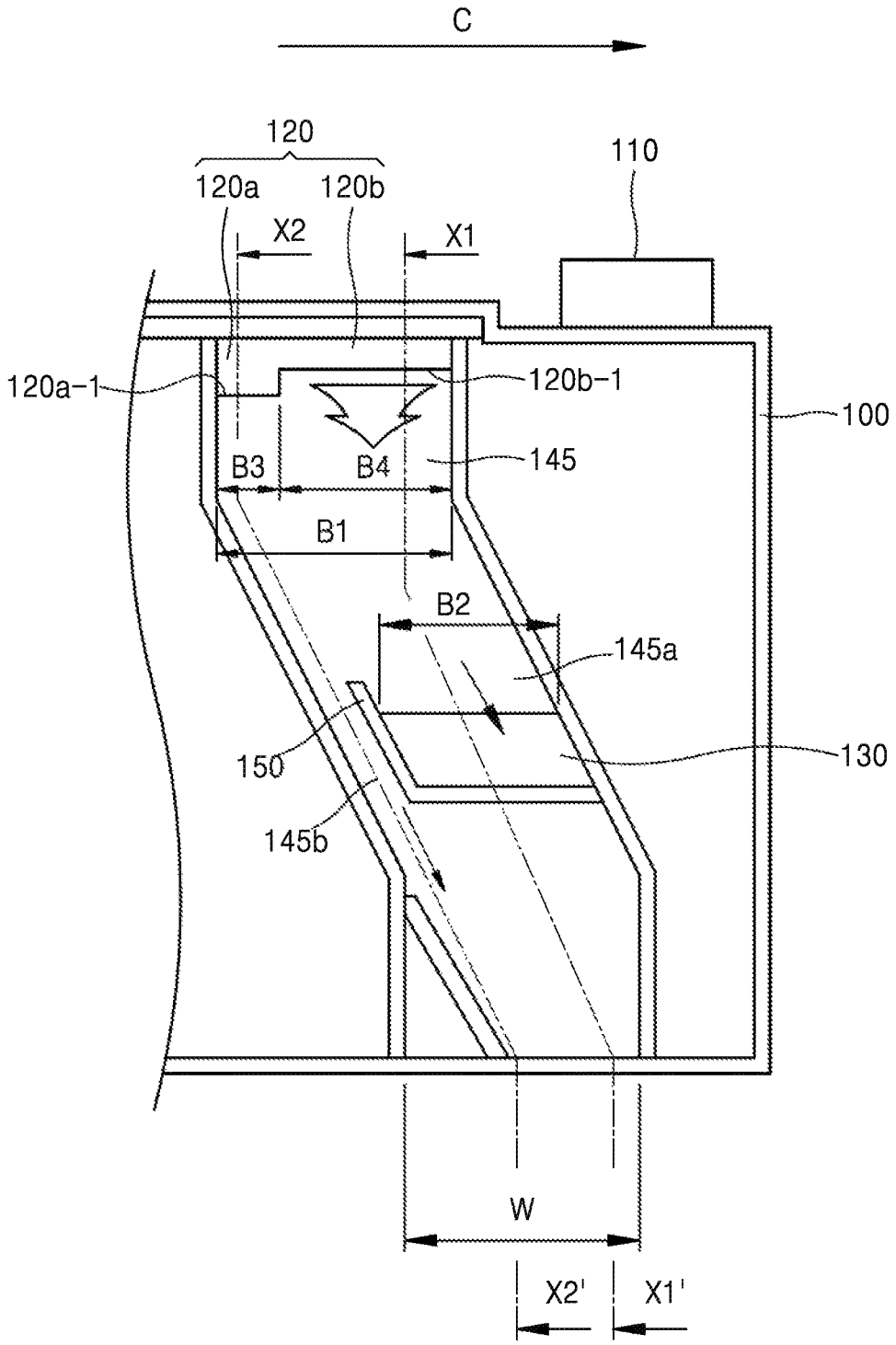
FIG. 5 is a schematic view showing a positional relationship between a developer discharge outlet and a developer collection outlet.

FIG. 2 is a cross-sectional view of the developing unit 10 according to an embodiment. FIG. 3 is a schematic side view of the developing unit 10 according to an embodiment. FIG. 4 is a partial perspective view of the developing unit 10 showing a developer discharging structure. FIG. 5 is a schematic view showing a positional relationship between a developer discharge outlet 120 and a developer collection inlet 130. As shown in FIGS. 2 to 5, the developing unit 10 includes a developing casing 100 and a developing roller 13 that is rotatably supported by the developing casing 100. A developer is accommodated in the developing casing 100. The developer may be supplied from the developer cartridge 20 as described above. The developing casing 100 includes a developer supply inlet 110 and the developer discharge outlet 120. The developer supply inlet 110 is an opening through which the developer is supplied from the developer cartridge 20. The developer discharge outlet 120 is an opening through which a surplus developer in the developing casing 100 is discharged. The developer supply inlet 110 and the developer discharge outlet 120 are located outside an effective image area A of the developing roller 13. The effective image area A is an area effectively used for image formation in a length direction of the developing roller 13.

The developer discharged through the developer discharge outlet 120 is discharged to the outside of the developing unit 10 through a discharge path 145. For example, the discharged developer may be accommodated in a waste developer container 18. The discharge path 145 may connect the developer discharge outlet 120 and the waste developer container 18. For example, a discharge cover 140 may form the discharge path 145 together with the developing casing 100.

When an amount of the developer in the developing casing 100 exceeds a reference amount, a surplus developer is naturally discharged through the developer discharge outlet 120. When rotating members including the developing roller 13 are rotated, an air pressure is formed inside the developing casing 100. Air inside the developing casing 100 is also discharged to the outside through the developer discharge outlet 120 by the air pressure. At this time, in addition to the surplus developer, the developer in the developing casing 100 may be carried in the air and discharged through the developer discharge outlet 120. Such a discharge of the developer is referred to as an airflow discharge. The airflow discharge is an unintentional discharge of the developer, whereby a developer level in the developing casing 100 may be lowered unintentionally lower than an appropriate level. An amount of the airflow discharge is increased as the developing unit 10 is operated at a high speed.

The developing unit 10 of the present embodiment collects a part of the developer discharged from the developer discharge outlet 120 into the developing casing 100 to prevent the developer from being excessively discharged and to maintain the developer level inside the developing casing 100 at the appropriate level. To this end, the developing casing 100 includes the developer collection inlet 130. The developer collection inlet 130 is provided in the discharge path 145. A collection guide member 150 for guiding the developer discharged along the discharge path 145 to the developer collection inlet 130 may be further provided. The collection guide member 150 branches the discharge path 145 into a first path 145*a* and a second path 145*b* such that a part of the developer discharged along the discharge path 145 is guided to the developer collection inlet 130 and the remaining is discharged from the developing unit 10.

According to this configuration, a part of the developer discharged from the developer discharge outlet 120 may be collected into the developing casing 100 through the developer collection inlet 130, thereby preventing the developer from being excessively discharged and stably maintaining a developer level in the casing 100 at an appropriate level. Therefore, a print image of a stable quality may be obtained during a lifetime of the developing unit 10. In addition, since air is discharged through the developer discharge outlet 120, the air pressure inside the developing casing 100 may be lowered, and thus a toner scattering through a gap between the developing roller 13 and the developing casing 100 may be reduced.

An end 151 of the collection guide member 150 on the side of the developer discharge outlet 120 is positioned closer to the developer discharge outlet 120 than an end 131 of the developer collection inlet 130 on the side of the developer discharge outlet 120. According to this configuration, the developer in the developing casing 100 may be prevented from being discharged to the outside through the developer collection inlet 130.

Referring to FIG. 5, the developer collection inlet 130 is disposed on a downstream side of the developer discharge outlet 120 with respect to a flow direction C of the developer toward the developer discharge outlet 120 in the developing casing 100. A vertical projection area B1 of the developer discharge outlet 120 is at least partially overlapped with a vertical projection area B2 of the developer collection inlet 130. According to this configuration, a part of the developer discharged through the discharge path 145 may be stably collected into the developing casing 100 through the developer collection inlet 130.

The developer discharge outlet 120 may include a first discharger 120*a* and a second discharger 120*b*. The first discharger 120*a* is cut deeper toward the developer collection inlet 130 than the second discharger 120*b*. In other words, an end portion 120*a*-1 of the first discharger 120*a* on the side of the developer collection inlet 130 is closer to the developer collection inlet 130 than an end portion 120*b*-1 of the second discharger 120*b* on the side of the developer collection inlet 130. According to this configuration, the developer exceeding an appropriate level in the developing casing 100 may be stably discharged through the first discharger 120*a*, and the second discharging opening 120*b* may reduce an amount of the airflow discharge through the developer collection inlet 130, thereby helping to prevent an excessive discharge of the developer.

The developer discharged through the first discharger 120*a* is mostly a surplus developer above the appropriate level in the developing casing 100. Therefore, the developer discharged through the first discharger 120*a* needs to be discharged to the outside of the developing unit 10. The collection guide member 150 may be at a position that does not overlap a vertical projection area B3 of the first discharger 120*a*. Thus, the surplus developer discharged through the first discharger 120*a* may be stably discharged to the outside of the developing unit 10 without being collected through the developer collection inlet 130.

The collection guide member 150 may be arranged to effectively guide the developer carried by the air to the developer collection inlet 130. To this end, the collection guide member 150 may be arranged to overlap a vertical projection area B4 of the second discharger 120*b*.

A thickness of the discharge path 145, that is, an interval between the discharge cover 140 and an outer surface of the developing casing 100, may be, for example, about 1.5 to about 3.0 mm. If the interval is smaller than 1.5 mm, the internal air pressure in the developing unit 10 increases and the toner scattering may be increased. If the interval is greater than 3.0 mm, an amount of air to be discharged increases, and the amount of the airflow discharge increases too, and thus, the developer may be excessively discharged. According to an experiment, when the interval is set to be about 1.5 to about 3.0 mm, the toner scattering of the developer does not occur when a process speed of the developing unit 10 is about 360 mm/second, and also, an excessive discharge of the developer does not occur. However, the scope of the present disclosure is not limited thereto, and a width W and a thickness of the discharge path 145 may be appropriately set according to a type and the process speed of the developing unit 10.

A shape of the developer discharge outlet 120 is not limited to the example shown in FIGS. 6A through 6G.

Figure 6A:
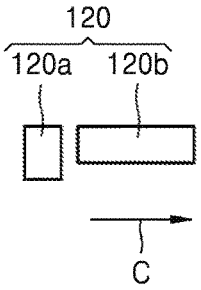
FIGS. 6A through 6G show various exemplary shapes of a developer discharge outlet.
Figure 6B:
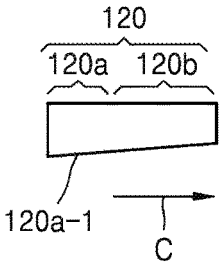
Figure 6C:
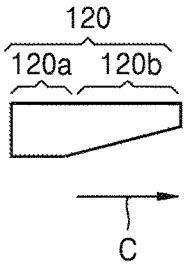
Figure 6D:
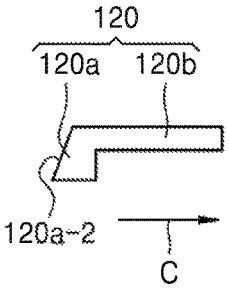
Figure 6E:
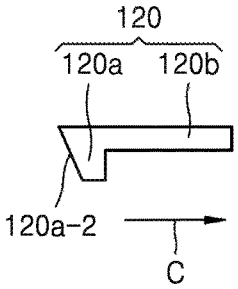
Figure 6F:
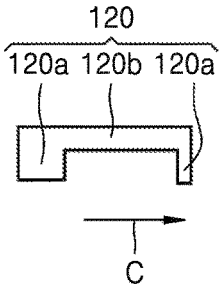
Figure 6G:
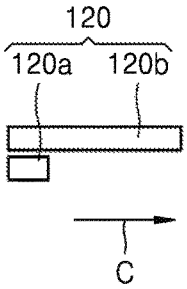

FIGS. 6A through 6G show various exemplary shapes of the developer discharge outlet 120. As shown in FIG. 6A, the first discharger 120*a* and the second discharger 120*b* may be separated from each other in a developer flow direction C. As shown in FIGS. 6B and 6C, the end portion 120*a*-1 of the developer discharge port 120 may be inclined so that a cutting depth of the developer discharge outlet 120 gradually decreases in the developer flow direction C. As shown in FIGS. 6D and 6E, a side end portion 120*a*-2 of the first discharger 120*a* may be in an oblique shape with respect to the developer flow direction C. As shown in FIG. 6F, a pair of first discharger 120*a* may be provided on both sides of the second discharge portion 120*b*. As shown in FIG. 6G, the first and second dischargers 120*a* and 120*b* may be disposed separately in a gravitational direction.

Figure 7:
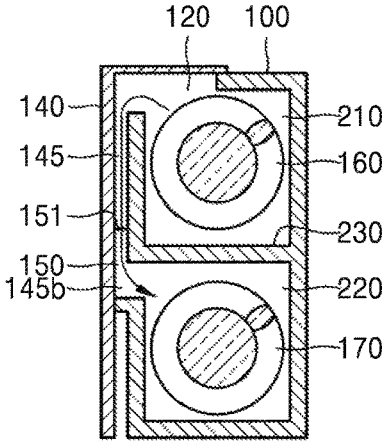
FIGS. 7 and 8 are respectively a cross-sectional view taken along a line X1-X1' and a cross-sectional view taken along a line X2-X2' in FIG. 5.
Figure 8:
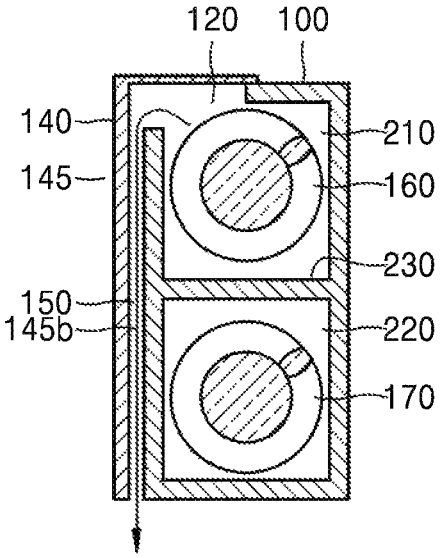

FIGS. 7 and 8 are respectively a cross-sectional view taken along a line X1-X1' and a cross-sectional view taken along a line X2-X2' in FIG. 5. Referring again to FIGS. 2, 3, 5, 7, and 8, the developing casing 100 includes a supplier 210 and a stirrer 220. The supplier 210 and the stirrer 220 are separated from each other by a partition 230. First and second openings 231 and 232 are provided at both ends of the partition 230 in a longitudinal direction. A first stirring member 160 and the developing roller 13 are disposed in the supplier 210. The first stirring member 160 stirs a developer in the supplier 210 while conveying the developer in a first direction D1. A second stirring member 170 is disposed in the stirrer 220. The second stirring member 170 stirs the developer in the stirrer 220 while conveying the developer in a second direction D2. The supplier 210 is positioned above the stirrer 220 in a gravitational direction. The developing roller 13 is positioned above the supplier 210 in the gravitational direction. Each of the first and second stirring members 160 and 170 may be, for example, an auger having an axis a longitudinally extending in a lengthwise direction of the developing roller 13 and a helical blade formed on an outer periphery of the axis. When the first stirring member 160 is rotated, the developer in the supplier 210 is conveyed in an axial direction of the first stirring member 160 to pass through a first opening 231 provided near one end of the partition 230 and is conveyed to the stirrer 220. The developer in the stirrer 220 is conveyed by the second stirring member 170 in a direction opposite a conveying direction by the first stirring member 160 and is conveyed to the supplier 210 through a second opening 232 provided near another end portion of the partition 230. Accordingly, the developer is circulated along the supplier 210 and the stirrer 220 and supplied to the developing roller 13 positioned in the supplier 210 in a circulation process.

The developer discharge outlet 120 is provided in the supplier 210. The developer discharge outlet 120 is located on a downstream side of the flow direction D1 of the developer in the supplier 210. The developer supply inlet 110 is located on a downstream side of the developer discharge outlet 120. The developer collection inlet 130 is provided in the stirrer 220. An end portion 151 of the collection guide member 150 may be positioned higher than the partition 230 to prevent the developer from being discharged to the outside of the developing unit 10 through the developer collection inlet 130.

As a toner is developed from the developing roller 13 to the photosensitive drum 14, an amount of the toner in the supplier 210 and the stirrer 220 is reduced. The developing unit 10 may further include a toner density sensor (not shown) for detecting a toner density in the developer. The toner density sensor may be provided, for example, in the stirrer 220. The toner density may be expressed as a ratio of weight of the toner to the total weight of the developer. The toner density sensor may be, for example, a magnetic sensor that indirectly detects the toner density by measuring intensity of a magnetic force by a carrier. If the carrier is relatively large and the toner is small in a detection region of the toner density sensor, intensity of a magnetic field detected by the magnetic sensor becomes large. Conversely, if the toner is relatively large in the detection region, the intensity of the magnetic field detected by the magnetic sensor becomes small. The magnetic sensor may detect the toner density using a relationship between the detected intensity of the magnetic field and the toner density. As another example, the toner density sensor may be a capacitance sensor that detects the toner density using a difference in the permittivity between the carrier and the toner. When the toner density detected by the toner density sensor is lower than a standard toner density, the developer may be replenished into the developing unit 10 through the developer supply inlet 110.

When the developing unit 10 is in operation, an air flow is generated inside the developing casing 100. The air flow is generated in a flow direction of the developer in the supplier 210, that is, in the first direction D1. The air flow is stronger as the number of revolutions of the first and second stirring members 160 and 170 and the developing roller 13 increases, and an air pressure inside the developing casing 100 increases too. The developer conveyed in the first direction D1 by the first stirring member 160 in the supplier 210 is discharged from the developing casing 100 through the developer discharging outlet 120 when a level of the developer in the supplier 210 exceeds an appropriate level in the supplier 210. The discharged developer is conveyed along the discharge path 145 and a part of the discharged developer is discharged to the outside of the developing unit 10 through the second path 145*b* and a part of the discharged developer is guided to the developer collection inlet 130 through the first path 145*a* and collected into the developing casing 100. Since the collection guide member 150 does not overlap with the vertical projection area B3 of the first discharger 120*a*, the developer discharged from the first discharger 120*a* falls mostly in a gravitational direction and is guided to the second path 145*b* and is discharged to the outside of the developing unit 10. Air and the developer carried by the air are mainly discharged from the second discharger 120*b*. The developer in the air is guided to the first path 145*a* by the collection guide member 150. Therefore, most of the developer in the air is collected into the developing casing 100, that is, the inside of the stirrer 220, through the developer collection inlet 130. In addition, since the developer collection inlet 130 is communicated with the developer discharge outlet 120 through the discharge path 145, the supplier 210 and the stirrer 220 communicate with each other. Then, an air flow is generated from the supplier 210 having a high air pressure to the stirrer 220 having a low air pressure, and the air pressure of the supplier 210 is lowered. When the air pressure of the supplier 210 is lowered, toner scattering through a gap between the developing roller 13 and the developing casing 100 may be suppressed. In addition, an amount of air discharged from the developer discharge outlet 120 is also reduced, so that an amount of the developer that is mixed and discharged into the air, that is, an amount of airflow discharge, may be reduced. Air may be introduced into the stirrer 220 through the discharge path 145 and the developer collection inlet 130. The air flowing into the stirrer 220 also influences fluidity of the developer. In the present embodiment, the developer in the stirrer 220 is pushed in a direction opposite to the gravitational direction and conveyed to the supplier 210. At this time, the air introduced into the stirrer 220 improves the fluidity of the developer, and thus the developer may be easily conveyed from the stirrer 220 to the supplier 210.

<Experimental Conditions>

Type of developing unit 10: A4, 55 PPM

Process speed: full speed 330 mm/sec, half speed 175 mm/sec

Outer diameter of the developing roller 13: 20 mm

Outer diameter of the photosensitive drum 14: 30 mm

Outer diameter of the first and second conveying members 160 and 170: 18 mm Initial developer amount in developing casing 100: 220 g Target developer amount in developing casing 100 in a stable state: 180 to 260 g Initial toner density: 9%

Experimental environment: N/N (24~25° C./40~45%)

In the case of the developing unit 10 of the present embodiment, the developing unit 10 is allowed to operate for 90 minutes without rotating the photosensitive drum 14 under the above experimental conditions. Then, the amount of the developer in the developing casing 100 is measured. The amount of toner scattering is evaluated based on an amount of the toner attached to the photosensitive drum 14 in 1 to 5 steps. It means that as the evaluated step is closer to 5, the amount of toner scattering is smaller.

Figure 9:
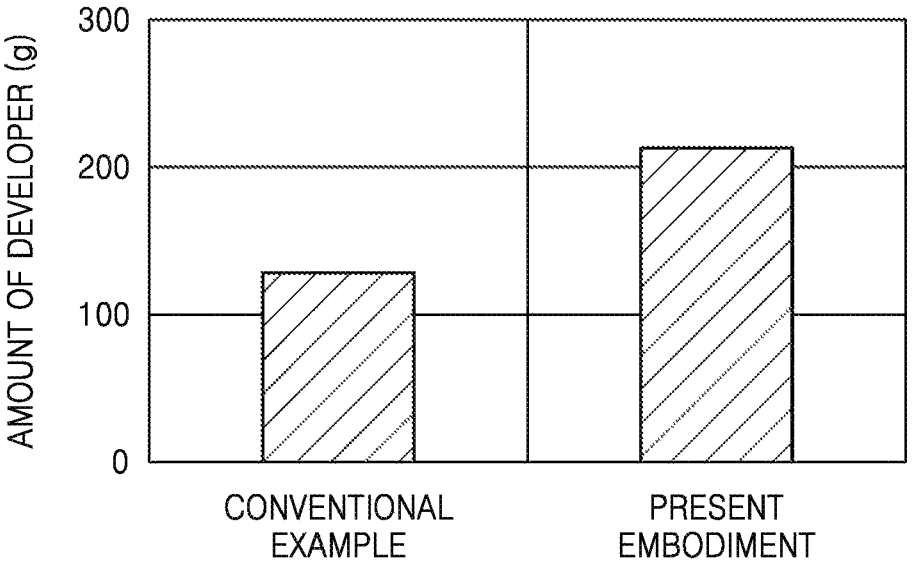
FIG. 9 is a graph showing a result of measuring an amount of a developer in a developing casing.
Figure 10:
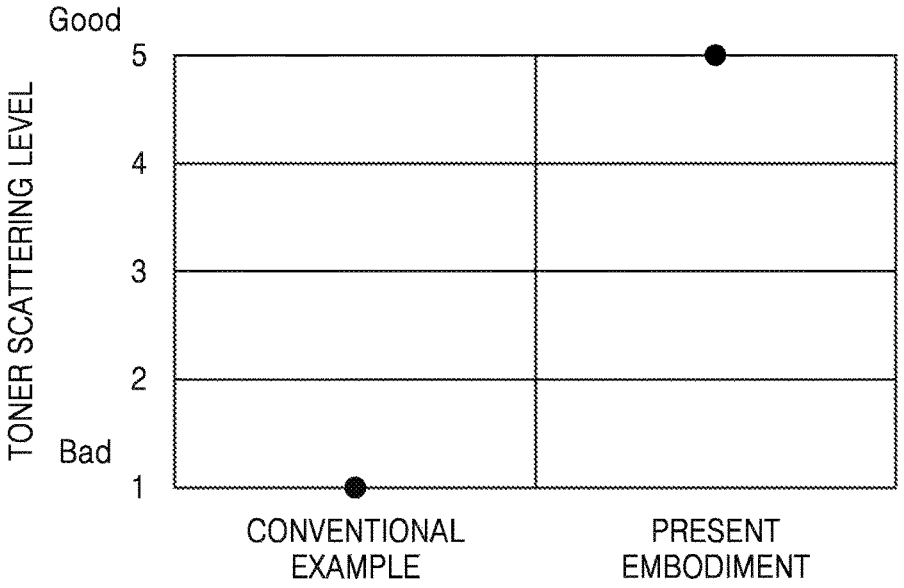
FIG. 10 is a graph showing a result of measuring an amount of toner scattering.
Figure 11:
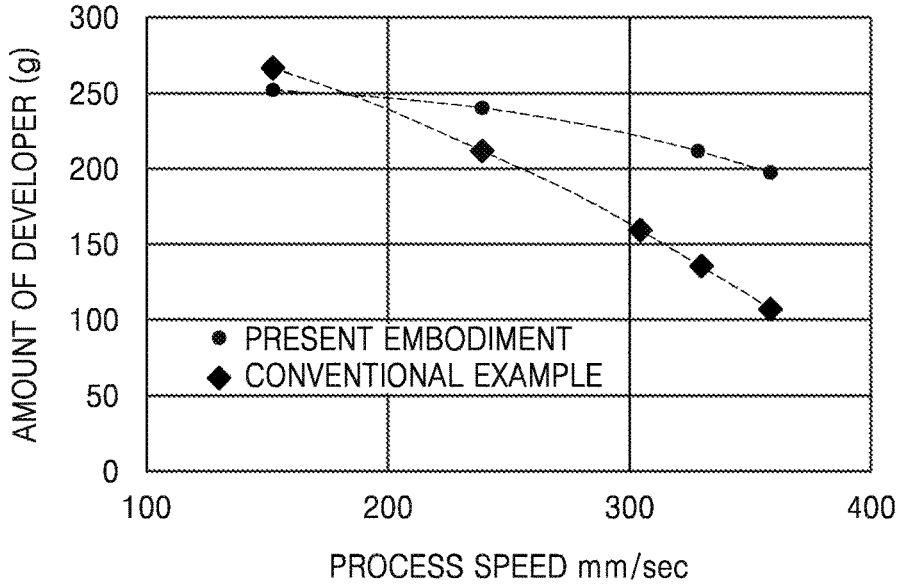
FIG. 11 is a graph showing a relationship between an amount of a developer and a process speed.

FIG. 9 is a graph showing a result of measuring an amount of a developer in the developing casing 100. FIG. 10 is a graph showing a result of measuring an amount of toner scattering. FIG. 11 is a graph showing a relationship between an amount of a developer and a process speed. In FIGS. 9, 10, and 11, a conventional example refers to a case in which the developer collection inlet 130 is not provided, and the present embodiment refers to a case in which the developer collection inlet 130 is provided. It may be seen from FIG. 9 that, in the conventional example, an excessive amount of a developer in the developing casing 100 is discharged so that the amount of the developer in the developing casing 100 is less than a target developer amount of 180 to 260, whereas, according to the developing unit 10 of the present embodiment, the amount of the developer inside is almost the same as an initial developer amount and is maintained at 180 to 260 g, which is the target developer amount at the time of stabilization. This means that since a new developer is supplied from the developer cartridge 20 to the inside of the developing casing 100 and only a surplus developer is stably discharged from the developing casing 100, a developer having stable performance is maintained at an appropriate amount inside the developing casing 100. From FIG. 10, it may be seen that according to the developing unit 10 of the present embodiment, the developing unit 10 has stable performance with little toner scattering.

After the developing unit 10 is operated for 90 minutes, the developer is supplied to the developing casing 100 in an amount of 10 g to confirm a discharge start time at which a discharge of the developer starts, and the developer in an amount of 20 g is additionally supplied to the developing casing 100 at the discharge start time. Then, an amount of the developer in the developing casing 100 is measured when the discharge of the developer is completely stopped. The graph of FIG. 11 shows a result of performing the above process in a process speed range of 175 mm/sec to 360 mm/sec. Referring to FIG. 11, the amount of the developer in the developing casing 100 is maintained within the range of 180 to 260 g, which is the target developer amount at the time of stabilization even when the process speed is increased.

Although the developing roller 13, the supplier 210 and the stirrer 220 are arranged in order in a gravitational direction in the above-described embodiment, an arrangement form of the developing roller 13, the supplier 210, and the stirrer 220 is not limited to the above-described embodiment. The arrangement form of the developing roller 13, the supplier 210, and the stirrer 220 may be appropriately changed in accordance with a layout of an image forming apparatus.

Figure 12:
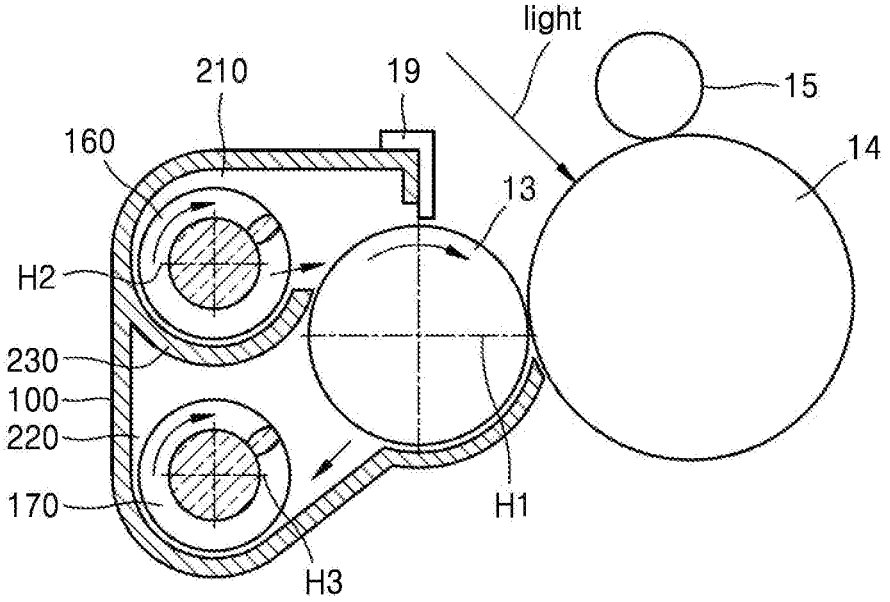
FIG. 12 is a schematic configuration diagram of a developing unit according to an embodiment.
Figure 13:
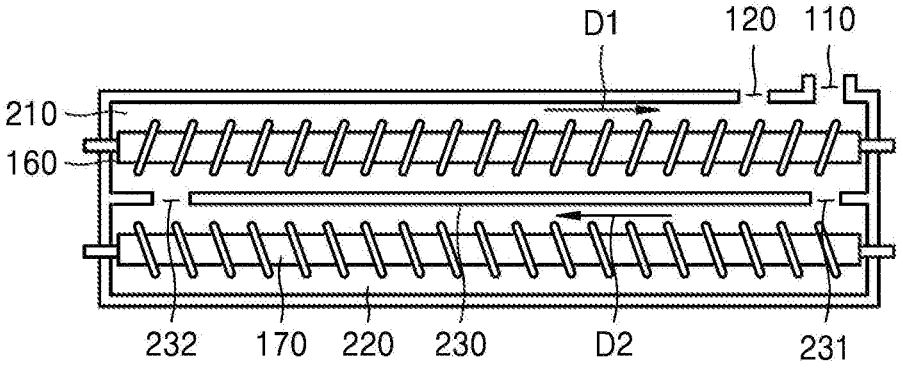
FIG. 13 is a schematic side view of the developing unit shown in FIG. 12 according to an embodiment.
Figure 14:
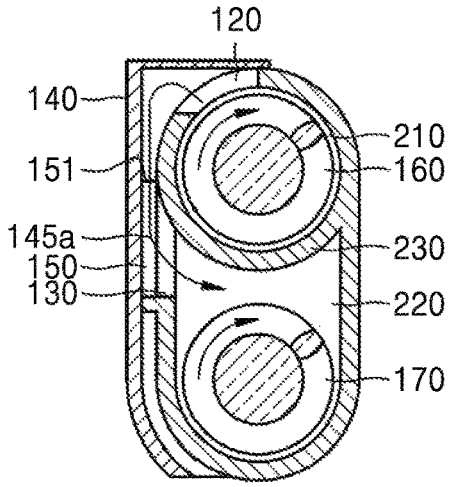
FIGS. 14 and 15 are sectional views corresponding to FIGS. 7 and 8, respectively, according to an embodiment of the developing unit shown in FIG. 12.
Figure 15:
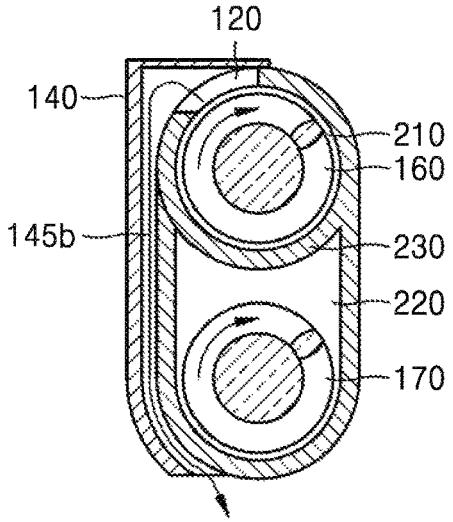

FIG. 12 is a schematic configuration diagram of the developing unit 10 according to an embodiment. FIG. 13 is a schematic side view of the developing unit 10 shown in FIG. 12 according to an embodiment. FIGS. 14 and 15 are sectional views corresponding to FIGS. 7 and 8, respectively, according to an embodiment of the developing unit 10 shown in FIG. 12. Referring to FIGS. 12 through 15, only the difference from the embodiment of the developing unit 10 shown in FIGS. 2 to 11 will be briefly described, and redundant descriptions will be omitted. The supplier 210 is positioned above the stirrer 220 in a gravitational direction. The developing roller 13 is positioned on a lateral side of the supplier 210 and the stirrer 220. A first horizontal line H1 passing through a center of the developing roller 13 is positioned between a second horizontal line H2 passing through a center of the first stirring member 160 and a third horizontal line H3 passing through a center of the second stirring member 170. The stirrer 220 is in communication with the developing roller 13. That is, the stirrer 220 partially faces the developing roller 13, and a developer separated from a surface of the developing roller 13 passing through a developing area is collected to the stirrer 220. The developer discharge outlet 120 is provided in the supplier 210. The developer collection inlet 130 is provided in the stirrer 220. The developer supply inlet 110 is provided on a downstream side of the developer discharge outlet 120 with respect to a flow direction D1 of the developer. The effect of the developing unit 10 according to the embodiment shown in FIGS. 12 to 15 is the same as that of the developing unit 10 according to the embodiment shown in FIGS. 2 through 11.

Figure 16:
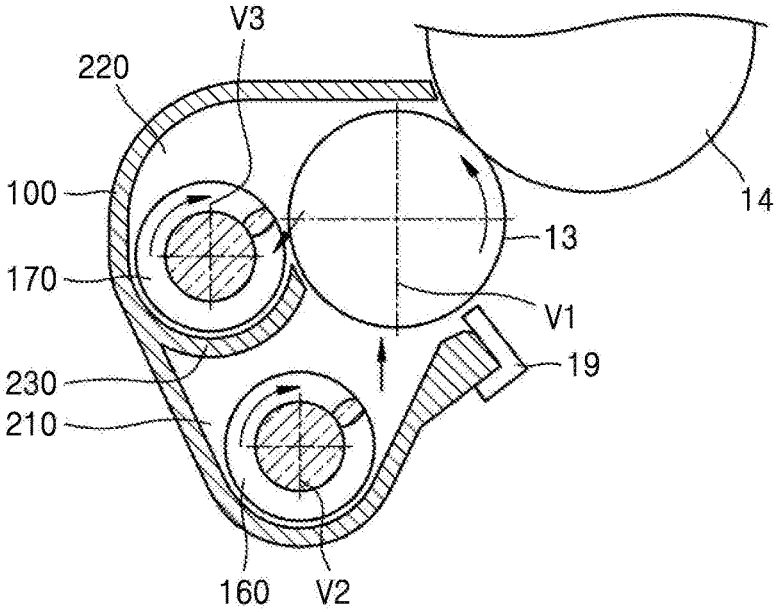
FIG. 16 is a schematic configuration diagram of a developing unit according to an embodiment.
Figure 17:
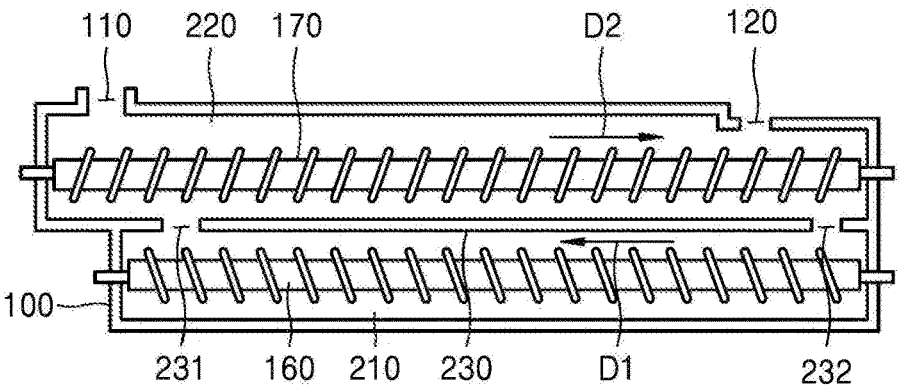
FIG. 17 is a schematic side view of the developing unit shown in FIG. 16 according to an embodiment.
Figure 18:
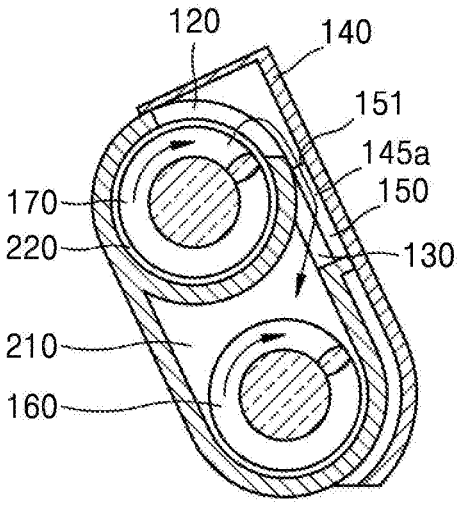
FIGS. 18 and 19 are sectional views corresponding to FIGS. 7 and 8, respectively, according to an embodiment of the developing unit shown in FIG. 16.
Figure 19:
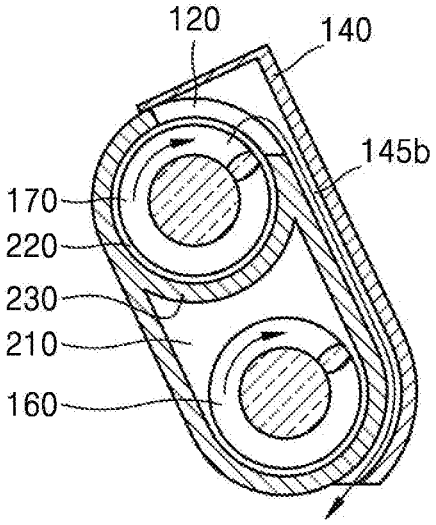

FIG. 16 is a schematic configuration diagram of the developing unit 10 according to an embodiment. FIG. 17 is a schematic side view of the developing unit 10 shown in FIG. 16 according to an embodiment. FIGS. 18 and 19 are sectional views corresponding to FIGS. 7 and 8, respectively, in an embodiment of the developing unit 10 shown in FIG. 12. Referring to FIGS. 16 to 19, only the difference from the embodiment of the developing unit 10 shown in FIGS. 2 to 11 will be briefly described, and redundant descriptions will be omitted. The supplier 210 is positioned below the stirrer 220 in a gravitational direction. The developing roller 13 is positioned on a lateral side of the supplier 210 and the stirrer 220. A second vertical line V2 passing through a center of the first stirring member 160 is positioned between a first vertical line V1 passing through a center of the developing roller 13 and a third vertical line V3 passing through a center of the second stirring member 170. The stirrer 220 is in communication with the developing roller 13. That is, the stirrer 220 partially faces the developing roller 13, and a developer separated from a surface of the developing roller 13 passing through a developing area is collected in the stirrer 220. The developer supply inlet 110 and the developer discharge outlet 120 are provided in the stirrer 220. With respect to the developer conveying direction D2 by the second agitating member 170, the developer supply inlet 110 is located at an upstream end of the second agitating member 170, and the developer discharge outlet 120 is located at a downstream end thereof. The developer collection inlet 130 is provided in the supplier 210. Therefore, the developer discharged from the stirrer 220 is partially collected to the supplier 210. The effect of the developing unit 10 according to the embodiment shown in FIGS. 16 to 19 is the same as that the developing unit 10 according to the embodiment shown in FIGS. 2 through 11.

Figure 20:
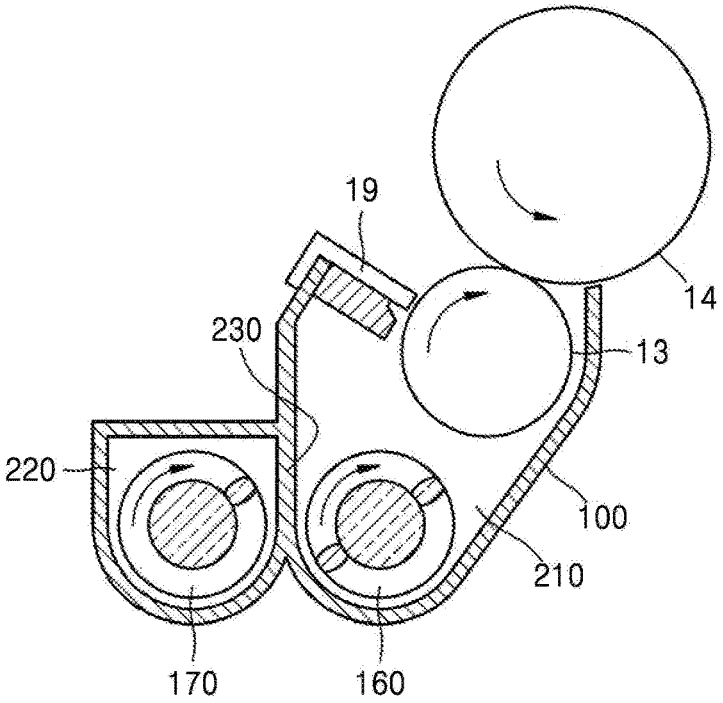
FIG. 20 is a schematic configuration diagram of a developing unit according to an embodiment.
Figure 21:
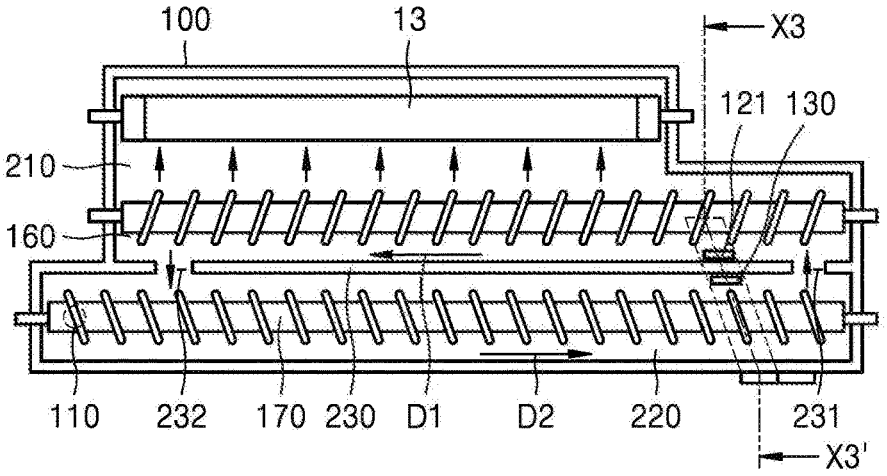
FIG. 21 is a schematic plan view of the developing unit shown in FIG. 20 according to an embodiment.
Figure 22:
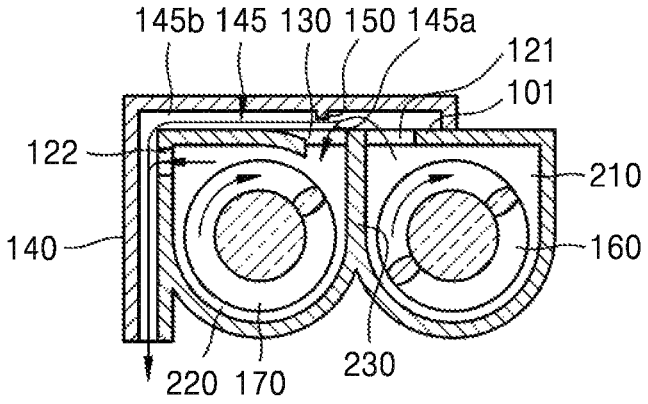
FIG. 22 is a cross-sectional view taken along the line X3-X3' in FIG. 20.

FIG. 20 is a schematic configuration diagram of the developing unit 10 according to an embodiment. FIG. 21 is a schematic plan view of the developing unit 10 shown in FIG. 20 according to an embodiment. FIG. 22 is a cross-sectional view taken along the line X3-X3' in FIG. 20. Referring to FIGS. 20 through 22, only the difference from the embodiment of the developing unit 10 shown in FIGS. 2 to 11 will be briefly described, and redundant descriptions will be omitted. The supplier 210 and the stirrer 220 are arranged side by side in a lateral direction. The developing roller 13 is positioned above the supplier 210. The developer supply inlet 110 is provided in the stirrer 220. The developer discharge outlet 120 includes a first developer discharge outlet 121. The first developer discharge outlet 121 is provided in the supplier 210. The developer collection inlet 130 is provided in the stirrer 220. The first developer discharge outlet 121 and the developer collection inlet 130 are formed in an upper wall 101 of the developing casing 100 forming upper walls of the supplier 210 and the stirrer 220. The discharge cover 140 is spaced from the upper wall 101 and forms the discharge path 145 with the upper wall 101. Thus, the discharge path 145 is formed above the first developer discharge outlet 121 and the developer collection inlet 130.

According to this configuration, the developer mixed with air and discharged from the supplier 210 through the first developer discharge outlet 121 is moved along the discharge path 145 and then falls due to gravity in the stirrer 220 through the developer collection inlet 130. Referring to FIG. 22, the collection guide member 150 extends from the inside of the discharge cover 140 toward the developer collection inlet 130. The discharge path 145 is branched by the collection guide member 150 to the first path 145*a* toward the developer collection inlet 130 and the second path 145*b* toward the outside of the developing unit 10. The developer mixed with air and discharged from the supplier 210 through the first developer discharge outlet 121 is struck by the collection guide member 150 and falls into the developer collection inlet 130. Therefore, the developer in the air may be effectively collected to the stirrer 220. The first developer discharge outlet 121 functions as the second discharger 120*b* in the embodiment shown in FIGS. 2 through 11.

Referring to FIG. 22, the developer discharge outlet 120 may further include a second developer discharge outlet 122. The second developer discharge outlet 122 is provided in the stirrer 220. When a developer level in the stirrer 220 reaches an appropriate level or becomes higher than the appropriate level, the developer is discharged from the stirrer 220 through the second developer discharge outlet 122. The developer is discharged to the outside through the discharge path 145. The second developer discharge outlet 122 functions the same as the first discharger 120*a* explained in the embodiment shown in FIGS. 2 through 11. The effect of the developing unit 10 according to the embodiment shown in FIGS. 20 through 22 is the same as the effect of the developing unit 10 according to the embodiment of shown in FIGS. 2 through 11.

While one or more embodiments have been described with reference to the figures, it will be understood by those of ordinary skill in the art that various changes in form and details may be made therein without departing from the spirit and scope as defined by the following claims.

What is claimed is:

1. A developing unit comprising:

a developing roller to rotate;

a developing casing to support the developing roller and including a developer supply inlet, a developer discharge outlet to discharge developer, and a developer collection inlet; and a discharge cover to form, along with the developing casing, a discharge path for the developer discharged from the developer discharge outlet, wherein the developer collection inlet is positioned in the discharge path to collect, into the developing casing, a part of the developer moving along the discharge path.

2. The developing unit of claim 1, wherein a projection area of the developer discharge outlet through which the developer is discharged in a gravitational direction from the developer discharge outlet partially overlaps a projection area of the developer collection inlet in which the developer is collected by the developer collection inlet.

3. The developing unit of claim 1, wherein the developer collection inlet is disposed on a downstream side of the developer discharge outlet with respect to a flow direction of the developer toward the developer discharge outlet in the developing casing.

4. The developing unit of claim 1, wherein the developer supply inlet is disposed on a downstream side of the developer discharge outlet with respect to a flow direction of the developer.

5. The developing unit of claim 1, wherein the developer discharge outlet, the developer supply inlet, and the developer collection inlet are located outside an effective length of the developing roller.

6. The developing unit of claim 1, further comprising:

a collection guide member, provided in the discharge path, to guide a part of the developer discharged along the discharge path to the developer collection inlet.

7. The developing unit of claim 6, wherein a distance from an end of the collection guide member on a side of the developer discharge outlet is closer to the developer discharge outlet than a distance from an end of the developer collection inlet on the side of the developer discharge outlet to the developer discharge outlet.

8. The developing unit of claim 1, wherein the developing casing comprises:

a supplier in which the developing roller and a first stirring member to convey a developer in a first direction are installed;

a stirrer in which a second stirring member to convey the developer in a second direction opposite to the first direction is installed; and a partition to separate the supplier from the stirrer, the partition having a first opening at a first end of the partition to allow the supplier to communicate with the stirrer and a second opening at a second end of the partition to allow the supplier to communicate with the stirrer.

9. The developing unit of claim 8, further comprising:

a collection guide member, provided in the discharge path, to guide a part of the developer discharged along the discharge path to the developer collection inlet, wherein a distance from an end of the collection guide member on a side of the developer discharge outlet to the developer discharge outlet is less than a distance from the partition to the developer discharge outlet.

10. The developing unit of claim 8, wherein the supplier is positioned above the stirrer in a gravitational direction, the developer discharge outlet is provided in the supplier, and the developer collection inlet is provided in the stirrer.

11. The developing unit of claim 10, wherein the developing roller is positioned above the first stirring member in the gravitational direction.

12. The developing unit of claim 10, wherein the developing roller is positioned adjacent to the first stirring member and the stirrer, the developing roller is between the first stirring member and the second stirring member with respect to the gravitational direction, and the stirrer is to collect the developer from the developing roller.

13. The developing unit of claim 8, wherein the first stirring member is positioned below the stirrer in a gravitational direction, the developing roller is positioned adjacent to the first stirring member and the stirrer, the first stirring member is between the second stirring member and the developing roller with respect to a lateral direction which is perpendicular to the gravitational direction, and the stirrer is to collect the developer from the developing roller.

14. The developing unit of claim 13, wherein the developer discharge outlet is provided in the stirrer, and wherein the developer collection inlet is provided in the supplier.

15. The developing unit of claim 8, wherein the supplier and the stirrer are disposed adjacent to one another in a lateral direction, the lateral direction being perpendicular to a gravitational direction.

16. The developing unit of claim 15, wherein the developing discharge outlet comprises a first developer discharge outlet provided in the supplier, the developer collection inlet is provided in the stirrer, and the discharge cover is to form the discharge path above the first developer discharge outlet and the developer collection inlet.

17. The developing unit of claim 16, further comprising:

a collection guide member, provided in the discharge path, to guide a part of the developer discharged along the discharge path to the developer collection inlet, wherein the collection guide member extends from the inside of the discharge cover toward the developer collection inlet so that a developer discharged from the first developer discharge outlet is partially guided to the developer collection inlet.

18. The developing unit of claim 16, wherein the developer discharge outlet further comprises a second developer discharge outlet provided in the stirrer, wherein the second developer discharge outlet is positioned in a downstream side of the developer collection inlet with respect to the discharge path.

19. An electrophotographic image forming apparatus comprising:

a developing unit to supply and develop a toner onto an electrostatic latent image formed on a photoconductor;

a transfer device to transfer a toner image onto a recording medium;

a fuser to fuse the toner image on the recording medium; and wherein the developing unit comprises:

a developing roller to rotate;

a developing casing to support the developing roller and including a developer supply inlet, a developer discharge outlet to discharge developer, and a developer collection inlet; and a discharge cover to form, along with the developing casing, a discharge path for the developer discharged from the developer discharge outlet, wherein the developer collection inlet is positioned in the discharge path to collect, into the developing casing, a part of the developer moving, along the discharge path.

* * * * *